United States Patent [19]

Wells et al.

[11] 4,190,167

[45] Feb. 26, 1980

[54] ADJUSTABLE WIRE DIVIDER

[76] Inventors: Richard E. Wells, 151 Avenida, La Habra, Calif. 91631; Frank L. Kinda, 1511 5th St., Manhattan Beach, Calif. 90266

[21] Appl. No.: 909,218

[22] Filed: May 25, 1978

[51] Int. Cl.[2] ..... A47F 5/01

[52] U.S. Cl. ..... 211/184; 108/61

[58] Field of Search ..... 211/184, 43, 106, 181; 108/60, 61; 248/221.3, 221.4, 226.1, 225.5

[56] References Cited

U.S. PATENT DOCUMENTS

| | | | |
|---|---|---|---|
| 2,538,908 | 1/1951 | McKeehan | 211/184 |
| 2,561,711 | 7/1951 | Ruf | 248/226.1 X |
| 3,015,399 | 1/1962 | Radek | 211/184 X |
| 3,196,632 | 7/1965 | Buffington | 211/184 X |
| 3,347,395 | 10/1967 | Marschak | 211/184 |
| 3,497,081 | 2/1970 | Field | 211/184 |

*Primary Examiner*—Roy D. Frazier
*Assistant Examiner*—Robert W. Gibson, Jr.
*Attorney, Agent, or Firm*—Freilich, Hornbaker, Wasserman, Rosen & Fernandez

[57] ABSTRACT

A wire divider for installation on a shelf, between the front and rear rows of holes therein, which can be installed on a variety of shelves with slightly different spacings between their front and rear holes, utilizing a divider construction which enables low cost production and reliable installation. The divider includes a plurality of wires forming a gate, including a heavy outer wire extending in a closed path with overlapping ends extending parallel to one another, and a foot which slides along the parallel wire portions and has hooks for reception in the shelf holes.

6 Claims, 8 Drawing Figures

ADJUSTABLE WIRE DIVIDER

BACKGROUND OF THE INVENTION

Dividers utilized in stores for mass merchandising, are typically constructed of wire fences with hooks at their front and rear ends for reception in the holes of shelves. The dividers must be sturdy, constructed at low cost, and easily installed on conventional shelves of the type that have a row of holes near the front and rear of the shelf. A highly successful divider which is in wide use, includes a heavy duty outer wire bent into a largely rectangular shape, a number of parallel short wires bridging the top and bottom of the outer wire and welded thereto, and a pair of hooks welded to the bottom of the outer wire at the front and rear of the divider. The outer wire is bent into a rectangular loop with the extreme wire ends in line but slightly spaced from one another along the bottom of the divider. The hooks can be installed by bending the divider to slightly separate the ends of the outer wire, to thereby separate the hooks so they can pass through the shelf holes. The divider is then released to spring back to its original configuration, with the hooks then lying fairly tightly in the shelf holes. Although this divider construction is very simple, it requires that the front and rear holes of the shelves be spaced a predetermined distance apart, such as 15 inches plus or minus perhaps 1/32nd of an inch. This is because the divider lengthens only about ⅛th inch when bent back, and a spring back of about 1/16th of an inch from the extended length is necessary to secure the hooks in the shelf holes.

A problem that has arisen is that different shelf manufacturers have adopted slightly different spacings between their front and rear rows of holes. For example, for a nominal 14-½ inch spacing, different manufacturers may utilize a spacing of the holes of between 14-¼ inches to 14-¾ inches. Accordingly, manufacturers of dividers have had to produce and stock many different dividers of the prior art type, all of a nominal 14-½ inch length but with different dividers designed for shelves of different shelf manufacturers. A divider which could be securely installed on shelves of the same nominal size but which varied appreciably in the spacing between front and rear holes, would greatly reduce the number of different sizes which had to be manufactured and stocked by a divider manufacturer. However, for any such divider to gain acceptance it would have to be producable at a low cost, comparable to that of prior art dividers, utilizing primarily the wire bending and welding equipment commonly found in divider manufacturing shops, with any additional components being easily manufactured in high volume, such as simple sheet metal stampings.

SUMMARY OF THE INVENTION

In accordance with one embodiment of the present invention, a wire divider is provided which can be installed on shelves with front-to-rear hole spacings, that vary within an appreciable range which can be constructed at low cost utilizing primarily wire bending and welding equipment and other low cost mass production equipment, and which can be securely installed on a shelf. The divider includes a heavy duty outer wire extending in a closed largely rectangular path, with the ends thereof overlapping and lying parallel to one another along the bottom of the divider. A foot with at least one hook thereon for reception in a shelf hole, is slidably engaged with both of the parallel wire portions to slide thereon without rotation. A spring biases the foot in a direction to keep the hook thereof securely engaged in a shelf hole, and to permit sliding of the hook sufficiently to enable installation in shelves having the same nominal front-to-rear hole spacings but wherein the hole spacings actually vary considerably.

The novel features of the invention are set forth with particularity in the appended claims. The invention will be best understood from the following description when read in conjunction with the accompanying drawings.

DESCRIPTION OF THE PREFERRED EMBODIMENT

Figure 1:
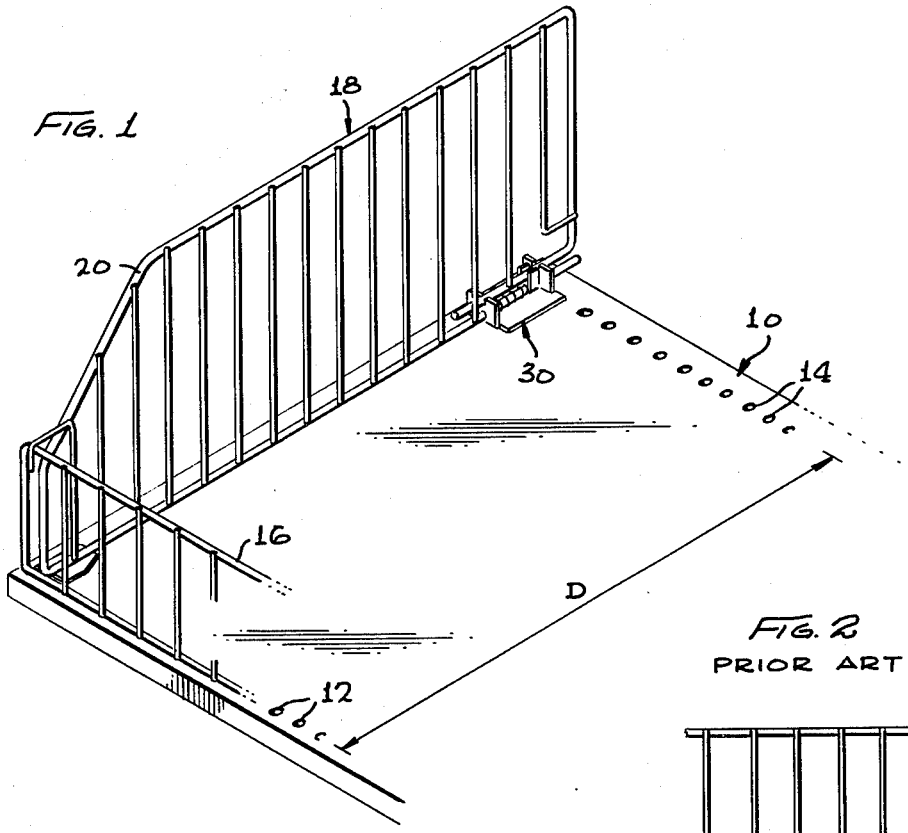
FIG. 1 is a partial perspective view of a shelf installation, showing a divider of the present invention installed thereon.

As shown in FIG. 1, a typical shelf installation for holding goods in a mass-merchandising store, includes a shelf 10 with a forward row of holes 12 and a rearward row of holes 14 spaced a distance D apart. A fence 16 lying at the front of the shelf, includes several projections that are installed in the front holes 12. A group of dividers 18 are installed transverse to the fence, to divide the region above the shelf into several different compartments. The divider 18 includes front and rearward hooks that hook into the holes 12, 14 respectively, so that dividers can be installed at chosen positions along the length of the shelf to divide it into compartments of a variety of widths. Both the fence 16 and divider 18 are constructed primarily of steel wires that are welded together, to provide low cost and sturdy see-through walls.

Figure 2:
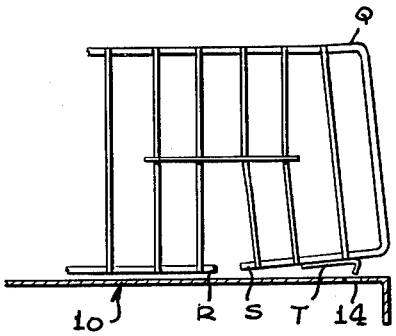
FIG. 2 PRIOR ART
FIG. 2 is a partial side elevation view of a divider of the prior art, in the process of installation on a shelf.

One prior art type of divider P shown in FIG. 2, included a heavy duty outer wire Q that was bent into a largely rectangular loop, with the ends R, S substantially abutting one another. A hook T could be installed on a rearward hole 14 of the shelf, by bending back the end S of the outer wire until the hook T could fit into the hole, as illustrated in FIG. 2. When the outer wire was then released, the bent-back wire end S sprung forward against the wire end R, to lock the hook T into the hole 14 of the shelf. This type of divider required that the distance D between the front and rear shelf holes be the same for all shelves, since the hook T could be pulled back only about ⅛th inch, and it was necessary that it spring back at least about 1/16th inch in order to reliably lock into the shelf. However, manufacturers of shelves have adopted a variety of slightly different hole spacings. For example, for one nominal size of shelf, one manufacturer may utilize a hole spacing D of 14-¼ inches, another manufacturer might utilize a spacing of 14-¾ inches, and other manufacturers might chose a variety of hole spacings in between these extremes. A manufacturer of dividers of the type P shown in FIG. 2, had to stock a large number of slightly different size dividers, in order to fit the shelves of the various shelf manufacturers. A variety of mechanisms could be designed to enable the hook T to lock into holes at a variety of spacings, if the amount of additional costs was not important. However, for any widely adjustable hook locking mechanism to be acceptable, it must be readily producable utilizing primarily the wire bending, cutting, and welding equipment commonly found in divider manufacturing shops. The additional cost of such a mechanism must be low enough that savings are realized by manufacturing and stocking such dividers, instead of manufacturing and stocking several sizes of the very simple dividers of FIG. 2.

In accordance with the present invention, a divider 18 as best shown in FIGS. 1 and 3–8 is provided, which can be installed on shelves whose front-to-rear hole spacings vary somewhat, and which can be constructed at low cost utilizing primarily the wire bending, cutting, and welding equipment found in divider manufacturing shops. The divider 18 includes an outer heavy duty wire 20 (FIG. 3) which extends in a largely rectangular loop, with end portions 22, 24 that overlap along the bottom edge of the divider near one end thereof such as the rearward end. The divider includes several smaller gauge wires 26 that extend primarily vertically, and are welded to the outer wire 20. The divider includes a forward foot with a hook 28 that pass through a pair of the forward holes 12 of a shelf, and a rearward foot 30 with hooks 32 that are received in the rearward holes 14 of the shelf. The foot 30 is slidably mounted on the two wire end portions 22, 24 to slide longitudinally thereon, so that the rearward hooks 32 can fit into rearward shelf holes 14 lying within a range of distances from the forward shelf holes 12.

Figure 4:
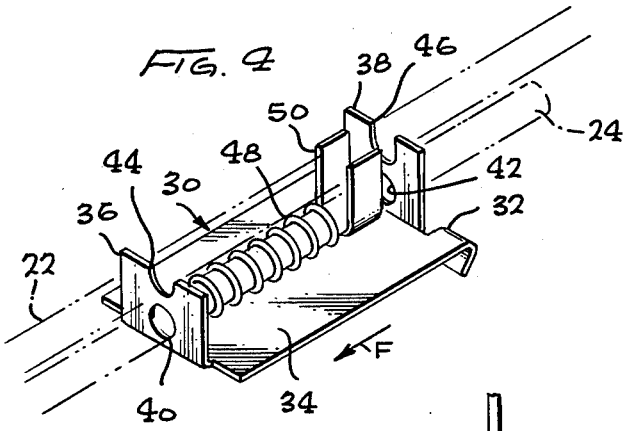
FIG. 4 is a partial perspective view of the divider of FIG. 3.
Figure 5:
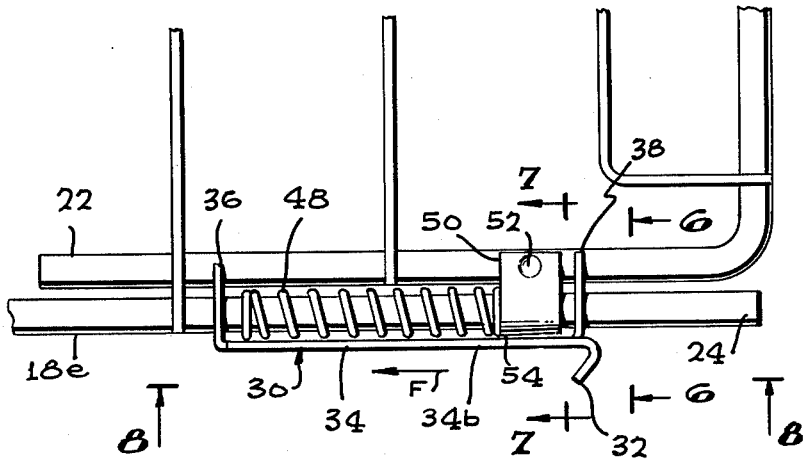
FIG. 5 is a partial side elevation view of the divider of FIG. 4.
Figure 3:
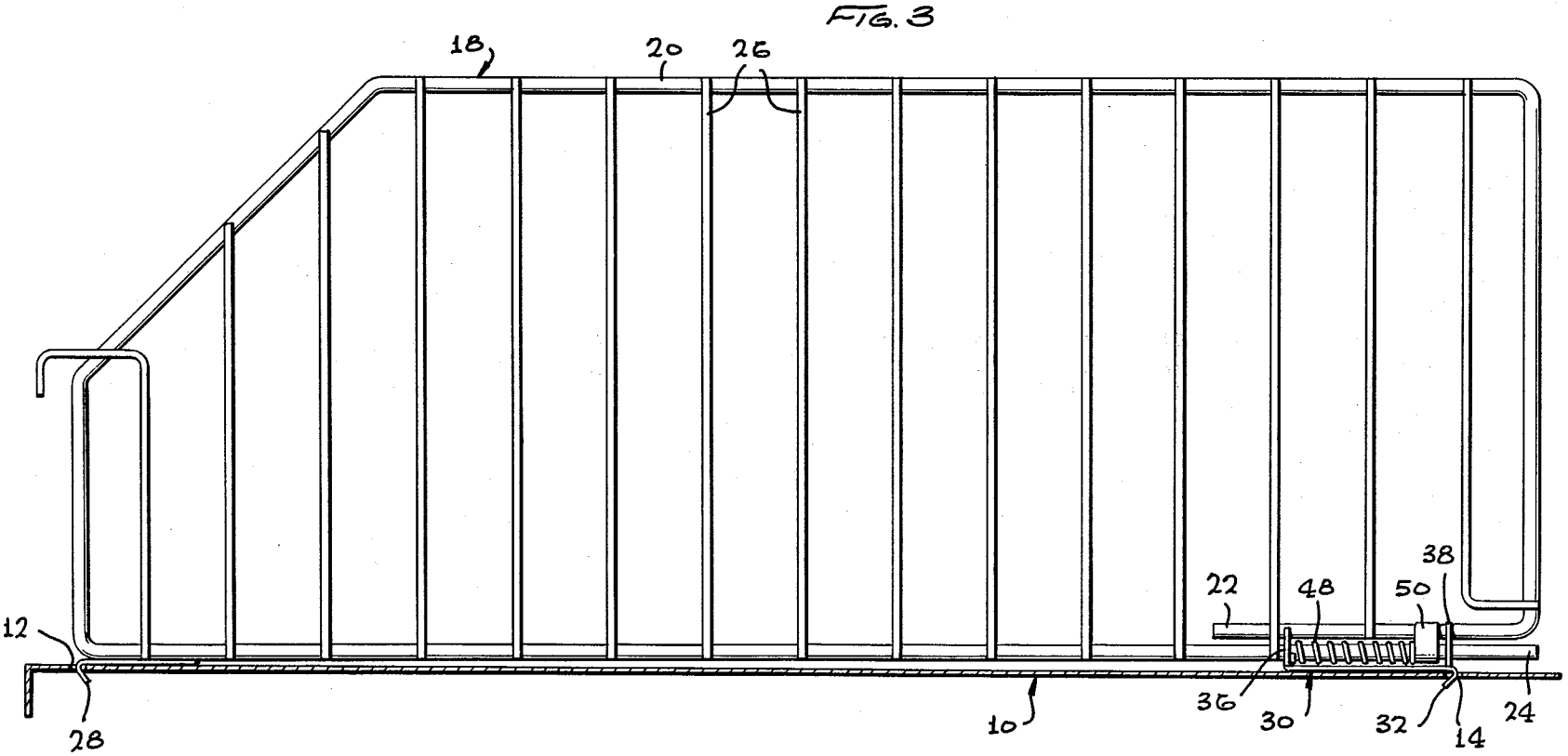
FIG. 3 is a side elevation view of the divider of FIG. 1.
Figure 8:
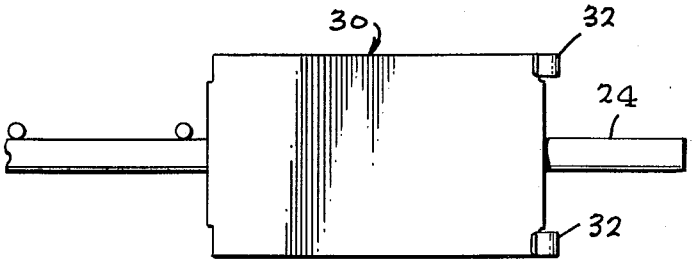
FIG. 8 is a view taken on the line 8—8 of FIG. 5.

As best shown in FIGS. 4 and 5, the foot 30 is a sheet metal part, with a plate-like middle portion 34 extending parallel to the wire portions 22, 24 and lying slightly below the lowermost wire portion 24, and with a pair of upstanding end flanges 36, 38. Each of the flanges 36, 38 has a hole 40, 42 that slidably receives the wire end portion 24, to permit the foot to slide longitudinally and be retained on the divider. In addition, each flange includes a cut-out or recess portion 44, 46 which is engaged with the upper wire portion 22, so that the upper wire portion 22 can avoid rotation of the foot about its axis of sliding.

Figure 7:
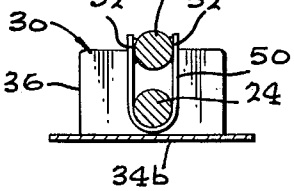
FIG. 7 is a view taken on the line 7—7 of FIG. 5.
Figure 6:
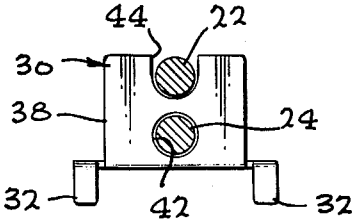
FIG. 6 is a view taken on the line 6—6 of FIG. 5.

A spring 48 biases the foot 30 in a forward direction, as indicated by arrow F, to lock the hooks 32 of the foot securely into the rearward shelf holes. The coil spring 48 surrounds the lower wire end portion 24, and lies between the two flanges 36, 38 of the foot. A clip 50 which is welded in place, abuts the rearward end of the coil spring to prevent it from moving rearwardly, and thereby enable the spring to press the foot forwardly. The clip 50 is constructed of a short strip of metal bent into a U-shape, installed with the curve of the U extending about the lowermost wire portion 24, as shown in FIG. 7, and with its leg ends welded at the two spots 52 to opposite sides of the upper wire portion 22. The bottom of the clip, at 54, can be deformed slightly downwardly, to more securely abut an end of the spring, although the clip will in any case prevent rearward movement of the spring.

The divider 18, including the sliding foot mechanism 60 thereof, can be constructed primarily of bent and welded wires, for which divider manufacturing shops are set up with the addition of simple sheet metal parts and simple coil springs. The divider can be constructed by first bending the outer wire 20 into a largely rectangular closed loop, with its ends 22, 24 overlapping and extending parallel to one another, as shown. The preformed sheet metal foot 30, spring 48, and clip 50, can all be installed by merely slipping them in a forward direction onto the rear of the wire portion 24. The cross wires 26 of the divider, and the clip 50, can then be all welded together, to provide a finished divider. A number of identical dividers can be stocked for use on shelves manufactured by a variety of manufacturers utilizing slightly different distances D between their forward and rearward holes. In one divider that has been constructed, the foot 30 was slidable by slightly more than ½ inch (by 9/16 inch) to enable installation on shelves whose hole spacings varied between 14-¼ and 14-¾ inches. It was found that the coil spring provided even better locking action than the typical prior art construction shown in FIG. 2, to provide a more stable divider. The bottom surface **34*b* (FIG. 5) of the sliding foot lay only about 1/16th inch below the lower edge of the lower wire portion 24, so that the lower wire edge 18*e*** lay very close to and extended substantially parallel to the shelf.

Thus, the invention provides shelf dividers which can be installed on shelves with hole spacings that vary within an appreciable range, and which can be constructed at low cost utilizing primarily the normal wire bending, cutting, and welding equipment found in divider manufacturing shops plus a minimum number of simple sheet metal parts and springs. This can be accomplished by a divider that utilizes an outer wire of the type normally bent into a substantially rectangular loop, wherein the ends of the loop overlap and extend parallel to one another along the bottom edge portion of the divider, such as along the rearward end of the lower divider edge. A locking foot with hooks thereon, can be installed on the two parallel wire portions, to permit slidable movement of the foot, but with the two wire portions preventing rotation of the foot around its axis of sliding. A coil spring extending about one of the wire portions biases the foot, while a simple clip welded to the wire portions abuts the spring to hold it in place.

Although particular embodiments of the invention have been described and illustrated herein it is recognized that modifications and variations may readily occur to those skilled in the art, and consequently, it is intended that the claims be interpreted to cover such modifications and equivalents.

What is claimed is:

1. A wire divider useful for installation on shelves with front and rear holes spaced by a moderately variable distance, comprising:

a plurality of wires forming a largely rectangular divider with first and second end portions and upper and lower edges, including an outer wire that extends substantially along a closed path and that has wire end portions that overlap along the second end portion of the lower edge to provide a pair of spaced parallel wire portions extending parallel to the lower edge of the divider;

means mounted at said first end portion of the divider to fit into a shelf hole;

a foot having at least one hook for reception in a shelf hole, said foot having wire-engaging portions slideably engaged with both of said parallel wire portions to slide parallel to said wire portions and prevent rotation of the foot about its axis of sliding; and a spring biasing said foot to slide in a predetermined direction along said wire portions.

2. The wire divider described in claim 1 wherein:

said spring comprises a coil spring extending about one of said wire portions, said coil spring having one end bearing against said foot and an opposite end supported against movement away from the foot.

3. A wire divider useful for installation on shelves with front and rear holes spaced by a moderately variable distance, comprising:

a plurality of wires forming a largely rectangular divider with upper and lower edges and first and second end portions, including a pair of parallel wire portions at said second end portion with a first of them lying along the lower edge;

a coil spring disposed about one of said wire portions;

a sheet metal foot having at least one hook means for engaging a shelf, said foot having a plate-like middle portion extending parallel to said first wire portion and lying slightly below it, and having a pair of upstanding end flanges with holes slideably receiving said first wire portion and with at least one flange having portions lying on opposite sides of the second wire portion to prevent turning of the foot, one of said end flanges abutting an end of said spring, whereby said foot is biased in a predetermined direction along said wire portions.

4. The divider described in claim 3 wherein:

said spring is disposed about said first wire portion; and including a clip extending around the first wire portion and having a pair of arms extending to and welded to either side of the second wire portions.

5. A wire divider useful for installation on shelves with front and rear holes spaced by a moderately variable distance, comprising:

a plurality of wires forming a largely rectangular divider with first and second end portions and upper and lower edges, including an outer wire that extends substantially along a closed path and that has wire end portions that overlap along the second end portion of the lower edge to provide a pair of spaced parallel wire portions extending parallel to the lower edge of the divider;

means mounted at said first end portion of the divider to fit into a shelf hole;

a foot having at least one hook for reception in a shelf hole, said foot slideably engaged with both of said parallel wire portions to slide parallel to said wire portions and prevent rotation of the foot about its axis of sliding;

a coil spring extending about the lowermost of said wire portions and biasing said foot to slide in a predetermined direction along said wire portions; and a clip which includes a band portion with a middle extending around one of the wire portions and a pair of legs extending against and welded to opposite sides of the other wire portions, said clip abutting an end of the spring.

6. A wire divider useful for installation on shelves with front and rear holes spaced by a moderately variable distance, comprising:

a plurality of wires forming a largely rectangular divider with first and second end portions and upper and lower edges, including an outer wire that extends substantially along a closed path and that has wire end portions that overlap along the second end portion of the lower edge to provide a pair of spaced parallel wire portions extending parallel to the lower edge of the divider;

means mounted at said first end portion of the divider to fit into a shelf hole;

a foot having at least one hook for reception in a shelf hole, said foot formed of a plate of sheet metal with a middle portion lying under said first wire portion and with a pair of upstanding flanges at opposite ends of said middle portion, said flanges forming portions slideably engaged with both of said parallel wire portions to slide parallel to said wire portions and prevent rotation of the foot about its axis of sliding; and a spring biasing said foot to slide in a predetermined direction along said wire portions.

* * * * *